US008845047B2

(12) United States Patent
Luisi et al.

(10) Patent No.: US 8,845,047 B2
(45) Date of Patent: Sep. 30, 2014

(54) REFRIGERATOR

(75) Inventors: Armando Luisi, Varese (IT); Jhon J. Vonderhaar, St. Joseph, MI (US); Martin D. Lewis, Paw Paw, MI (US); Luiz A. Lopes, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 2244 days.

(21) Appl. No.: 11/622,025

(22) Filed: Jan. 11, 2007

(65) Prior Publication Data

US 2007/0228907 A1 Oct. 4, 2007

(30) Foreign Application Priority Data

Jan. 13, 2006 (EP) ..... 06100327

(51) Int. Cl.
*A47B 96/04* (2006.01)
*F25D 23/06* (2006.01)

(52) U.S. Cl.
CPC ..... *F25D 23/069* (2013.01)
USPC ..... 312/407

(58) Field of Classification Search
USPC ..... 312/401, 404, 405, 406, 406.2, 407, 312/351, 400, 408, 257.1; 62/447, 449, 62/382, 440, 441; 211/134, 153, 151, 162, 211/94.01, 175, 207, 189
See application file for complete search history.

(56) References Cited

U.S. PATENT DOCUMENTS

| | | | | | |
|---|---|---|---|---|---|
| 3,179,367 | A * | 4/1965 | Rapata | 248/239 |
| 3,601,463 | A * | 8/1971 | Watt | 312/406 |
| 3,674,359 | A * | 7/1972 | Crowe, W.P. | 312/407 |
| 3,726,578 | A * | 4/1973 | Armstrong | 312/407 |
| 3,872,688 | A * | 3/1975 | Tillman | 62/329 |
| 3,913,996 | A * | 10/1975 | Benford | 312/406 |
| 3,940,195 | A * | 2/1976 | Tillman | 312/406.1 |
| 3,989,329 | A | 11/1976 | Benford | |
| 4,627,246 | A * | 12/1986 | Wilson | 62/286 |
| 4,638,644 | A * | 1/1987 | Gidseg | 62/329 |
| 4,860,921 | A | 8/1989 | Gidseg | |
| 4,876,860 | A * | 10/1989 | Negishi | 62/179 |
| 5,154,502 | A | 10/1992 | Takaoka | |
| 5,349,832 | A * | 9/1994 | Johnson et al. | 62/447 |
| 5,540,492 | A * | 7/1996 | Dasher et al. | 312/404 |
| 5,577,822 | A * | 11/1996 | Seon | 312/404 |
| 6,698,603 | B2 * | 3/2004 | Lawson et al. | 211/94.01 |
| 2003/0038570 | A1 * | 2/2003 | Parrott | 312/407 |
| 2004/0012315 | A1 * | 1/2004 | Grace et al. | 312/406 |
| 2004/0148949 | A1 * | 8/2004 | Parachini et al. | 62/126 |
| 2004/0174108 | A1 * | 9/2004 | Benitsch et al. | 312/408 |
| 2005/0093408 | A1 * | 5/2005 | Koloff et al. | 312/404 |

* cited by examiner

*Primary Examiner* — James O Hansen

(57) ABSTRACT

The present invention relates to a refrigerator comprising a cabinet having at least one partition wall to separate at least two sub-compartments and an elongated support device having a C-shaped cross section mounted to the cabinet wall and into which a partition wall can be inserted.

11 Claims, 3 Drawing Sheets

REFRIGERATOR

BACKGROUND OF THE INVENTION

1. Field of the Invention

The present invention relates to a refrigerator comprising a cabinet in which a food storage compartment is defined, wherein the cabinet has at least one partition wall to separate at least two sub-cavities.

2. Description of the Related Art

Home refrigerators are commonly known. A typical refrigerator includes one freezer compartment and one fresh food compartment. The two compartments are typically divided by an insulated divider panel formed as part of the cabinet. As such, the divider panel is in a fixed location and cannot be adjusted by a user. Thus, an improvement would be to provide adjustable divider panels to provide customizable compartments.

A refrigerator of this kind is disclosed by U.S. Pat. No. 5,577,822 to Seon, in which a divider panel is vertically adjustable for increasing a volume of one of the sub-compartments (for instance the freezer compartment) while simultaneously reducing the volume of the other sub-compartment (for instance the fresh food compartment). The purpose of this refrigerator is to change the relative volumes of the freezer and fresh food compartments. However, this patent does not provide any information on how the cabinet walls can be formed in order to facilitate the insertion of divider panels into holes of the inner wall of the cavity. Additionally, this patent does not provide any information on including a divider panel that is horizontally adjustable or including multiple divider panels.

SUMMARY OF THE INVENTION

One aspect of the present invention is to provide a modular refrigerator having components that can be easily reconfigured to produce different products at a low cost. Thus, an aim of the present invention is to easily create two or more compartments inside a refrigerator cabinet by using panels as dividers.

An important aspect for the production of refrigerators is the high cost of developing and manufacturing tooling and equipment. The applicant has developed a new method to build refrigerators limiting the costs and time to bring a product to market.

One embodiment of the invention is a refrigerator comprising a cabinet having at least one partition wall to separate at least two sub-compartments and an elongated support device having a C-shaped cross section mounted to the cabinet wall and into which a partition wall can be inserted.

The elongated support device may be constructed of extruded polymeric material and may be U-shaped to match the cross section of the cabinet. Additionally, the cross section of the elongated support device may present a central substantially flat portion and two hollow end portions. The central portion may present at least one hollow portion to form a seal between the support device and the partition wall. The end portions may present at least one protrusion to form a seal between the support device and the partition wall. The elongated support device may be mounted to the cabinet wall using rivers inserted through holes in said cabinet wall.

Another embodiment of the invention is a reconfigurable refrigerator comprising a cabinet, at least one partition wall, and an elongated support device, wherein the partition wall is inserted into the elongated support device to provide a customized number of compartments within the cabinet.

The partition wall may be horizontally or vertically mounted within the cabinet. The elongated support device may have a C-shaped cross section to mount within the cabinet. The cross section may present a central substantially flat portion and two hollow end portions. The central portion may present at least one hollow portion to form a seal between the support device and the partition wall. The end portions may present at least one protrusion to form a seal between the support device and the partition wall.

The compartments may have an access opening terminated by either a door or a drawer.

Another embodiment of the invention is a refrigerator comprising a cabinet, at least one freezer compartment, and at least one fresh food compartment, wherein the freezer compartment and fresh food compartment are separated by a partition wall inserted into an elongated support device having a C-shaped cross section.

The refrigerator may further comprise at least one storage compartment separated from the freezer compartment and fresh food compartment by a partition wall. The storage compartment may have an access opening comprising a drawer or door.

The elongated support device may be U-shaped to match the cross section of the cabinet. The cross section of the support device may present a central substantially flat portion and two hollow end portions, wherein the end portions have at least one protrusion to form a seal between the support device and the partition wall.

DETAILED DESCRIPTION OF THE PREFERRED EMBODIMENTS

Figure 1:
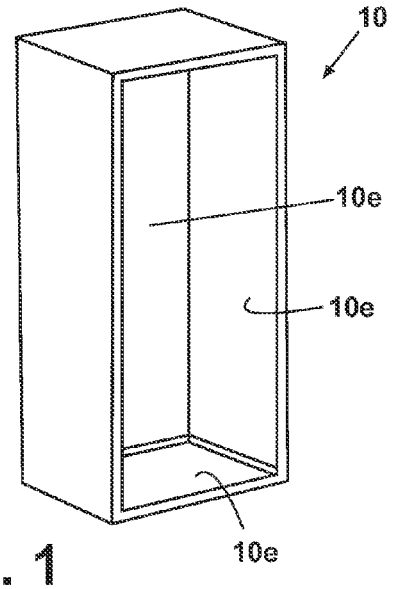
FIG. 1 is a perspective view of a cabinet of a refrigerator.

A refrigerator will now be described in detail with initial reference to the illustrative embodiment of the invention as shown in FIG. 1. A refrigerator is provided having a cabinet 10 which may be designed and manufactured as a single cavity. The cabinet 10 further comprises inner walls 10*a*.

These walls 10*a* lack any ribs or shelf supports, thus allowing for free positioning of at least one divider panel 12 inside the cabinet 10.

The insulation thickness of the cabinet 10 may be the same for the entire cabinet. An insulation thickness is typically about 30-35 mm (about 1.2"-1.4") for the fresh food compartment, and about 50-60 mm (about 2.0"-2.4") for the freezer compartment. Thus, a thickness of approximately 45 mm results in higher insulation in the fresh food compartment and lower insulation in the freezer compartment. It has been calculated for the present invention that the total energy consumption is not penalized when utilizing an appropriate insulation thickness, preferably between 35 and 50 mm.

Since the construction according to the invention allows for many potential compartment configurations, the cabinet 10 is designed to accept free positioning of hinges on the front flange in order to mount the door. One method to accomplish this is to design the front flange of the cabinet with a reinforcement in the back side thereof. This reinforcement may be on all or a portion of the perimeter.

Figure 2:
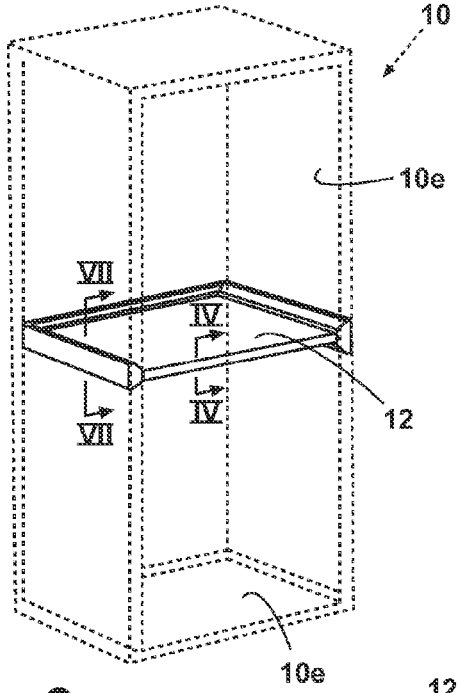
FIG. 2 is a perspective view of a first embodiment of the refrigerator of the present invention.
Figure 3:
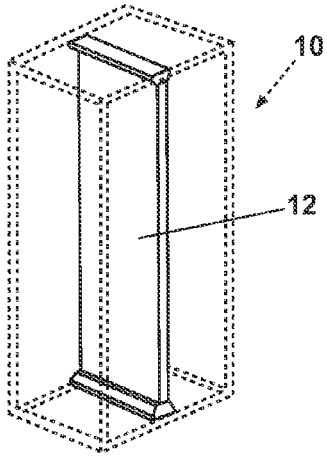
FIG. 3 is a perspective view of a second embodiment of the refrigerator of the present invention.

Two configurations for the divider panels 12 are shown in FIGS. 2 and 3. As shown in FIG. 2, the cabinet 10 may include at least one horizontal divider panel 12, thus allowing for a top mount or bottom mount refrigerator configuration. As shown in FIG. 3, the cabinet 10 may include at least one vertical divider panel 12, thus allowing for a side by side refrigerator configuration. The shape of the panels 12 matches the horizontal and vertical cross sections of the cabinet, respectively. These divider panels 12 could make many other configurations having customizable compartment sizes. Additionally, horizontal divider panels and vertical divider panels could be used in combination, thus creating additional compartments. It can be readily understood that the panel design and configuration could be changed without altering the function of the invention.

In the preferred embodiment, the panels have a "sandwich" construction having core insulation surrounded on both sides by plastic or other materials such as metal. The insulation material may be polyurethane foam. The panels would preferably use the same material and color as the cabinet inner walls.

Figure 4:
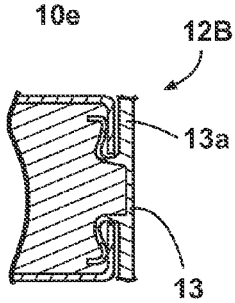
FIG. 4 is a cross sectional view along line IV-IV of FIG. 2.
Figure 5:
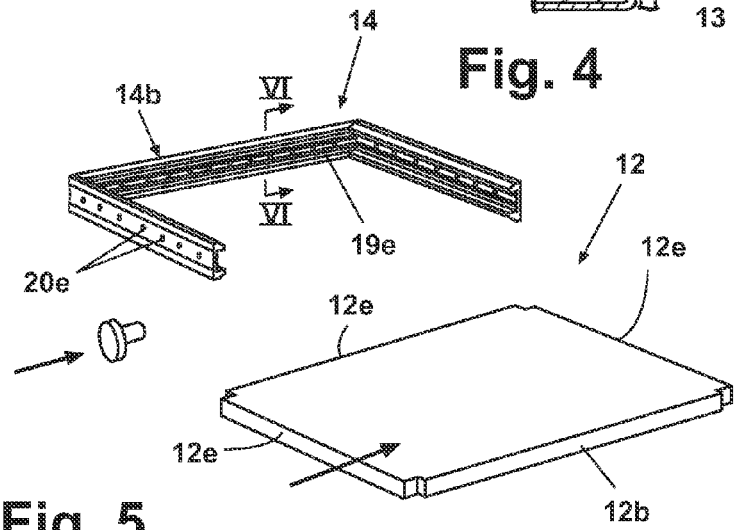
FIG. 5 is an exploded view of the partition wall and elongated support device.

Referring to FIGS. 4 and 5, the three edges 12*a* of the panel 12 that are in contact with the inner cabinet walls 10*a* may be covered by a layer of plastic to aid in the prevention of humidity infiltration into the insulation material. The front edge 12*b* may be constructed of a plastic strip 13 further comprising a polarized magnet 13*a* integrated into the plastic. This allows for the use of a magnetic door gasket and avoids the installation of a costly device to defrost the gasket sealing surface of the doors. Alternatively, it is possible for the front edge 12*b* to be constructed of a steel strip further comprising an electric heater to defrost the gasket sealing surface. The thickness of these panels 12 can be about 40 mm (about 1.6").

Figure 6:
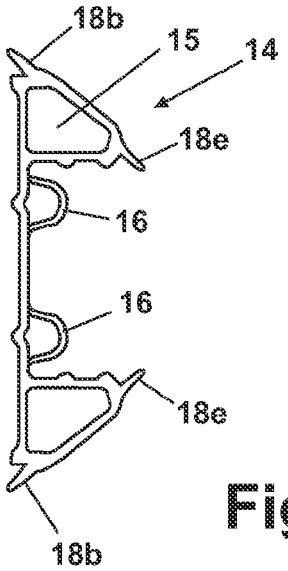
FIG. 6 is a cross sectional view along line VI-VI of FIG. 5.
Figure 7:
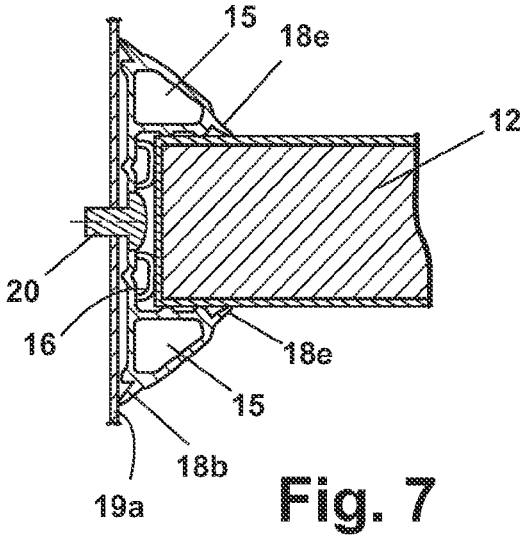
FIG. 7 is a cross sectional view along line VII-VII of FIG. 2.

In order to mount the panels 12 into the cabinet 10, an elongated support device 14 is used, as shown in FIGS. 5-7. The elongated support device 14 may comprise a plastic profile with a rigid structure having a C-shaped cross section. Thus, the shape of the elongated support device 14 is U-shaped to match the cross section of the cabinet 10, and may be either horizontally or vertically mounted within the cabinet. A side 14*a* of the elongated support device 14 mates with the edges 12*a* of the panel 12 while an opposite side 14*b* is in contact with the inner walls 10*a* of the cabinet. The side 14*a* of the elongated support device 14 may have a central flat portion and two hollow end portions 15 which define the C-shaped cross section of the elongated support device 14. This configuration aids in the prevention of air infiltration between compartments. The elongated support device 14 may have one or more integrated gaskets that provide a seal between the elongated support device 14 and the cabinet wall, as shown in FIG. 6. These gaskets are defined by hollow sections 16 on the central flat portion of the side 14*a* of the elongated support device 14, and by flexible protrusions 18*a* and 18*b* adapted to engage the panel 12 with the inner wall 10*a*. The elongated support device 14 with the integrated gaskets 16, 18*a*, 18*b* may be manufactured by a dual co-extrusion process. In the preferred embodiment, the materials for the rigid profile of the elongated support device 14 and for the gaskets are compatible, thus creating a strong bond. The invention further comprises one or more rivets 20 that may be made of a material such as nylon, to fix the elongated support device 14 to the inside wall 10*a* of the cabinet 10. The rivets 20 project through holes 20*a* in the elongated support device 14 and also through corresponding holes (not shown) in the plastic liner.

Figure 8:
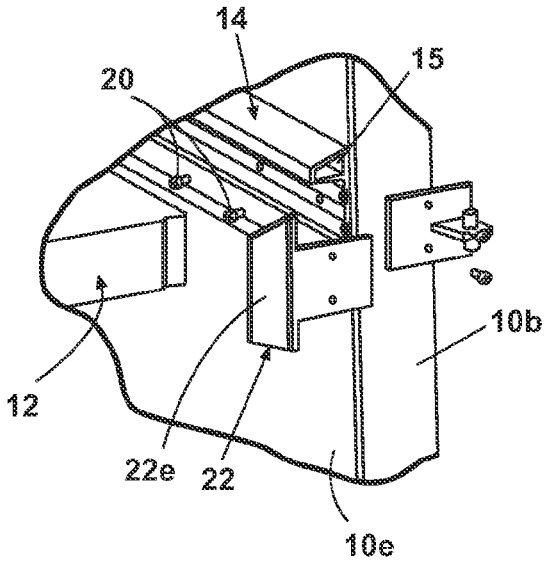
FIG. 8 is a fragmentary, exploded view of a portion of FIG. 2.
Figure 9:
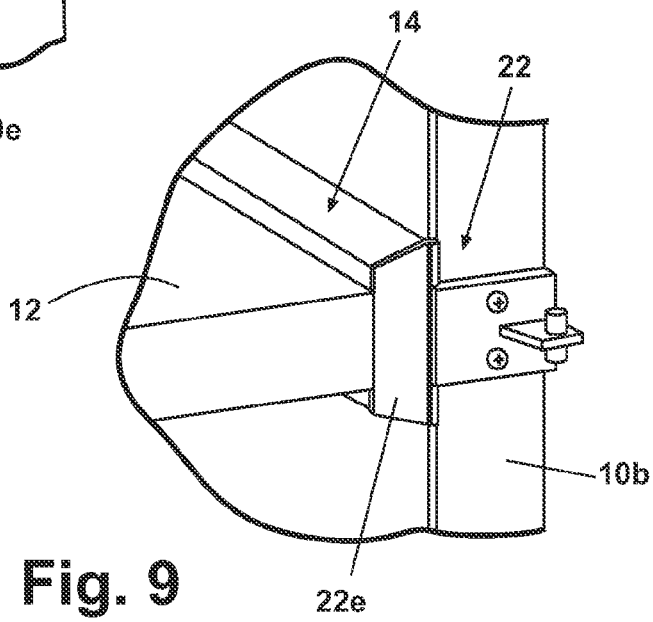
FIG. 9 is a fragmentary, perspective view of a portion of FIG. 2 in an assembled configuration.

Once the elongated support device 14 is assembled in the cabinet 10, the next operation is the assembly of the panel 12. The panel slides into the groove defined by the C-shaped profile of the elongated support device 14. The panel stays in place due to the seal between the gaskets 16, 18*a* and 18*b*. As shown in FIGS. 8 and 9, two flat stoppers 22 are used to hold the panel 12 in place. The stoppers 22 can be attached to the cabinet front flange 10*b* or may be integrated into the door hinges of the refrigerator doors. These stoppers 22 may have an extension 22*a* that interlocks with the front section of the elongated support device 14 to cover the visible ends of the elongated support device 14 and a portion of the panel 12. Once in place, the rivets 20 have heads protruding from the elongated support device 14. Once assembled, the edges 12*a* of the panels are in contact with the rivet heads, which helps to hold the rivets in place.

Figure 11:
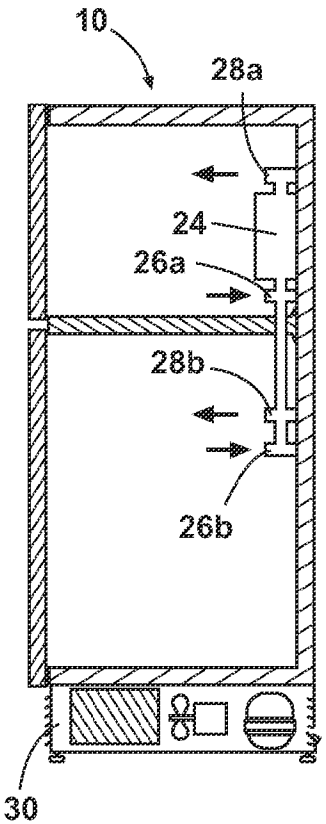
FIG. 11 is a cross sectional view along line XI-XI of FIG. 10*b*.
Figure 10D:
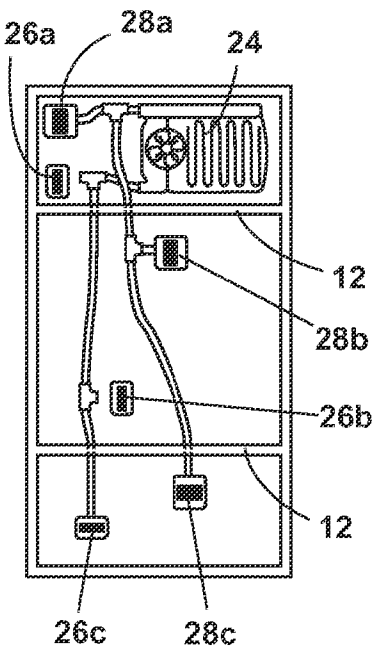
FIG. 10*d* is a schematic view of a configuration of a refrigerator according to an embodiment of the present invention
Figure 10C:
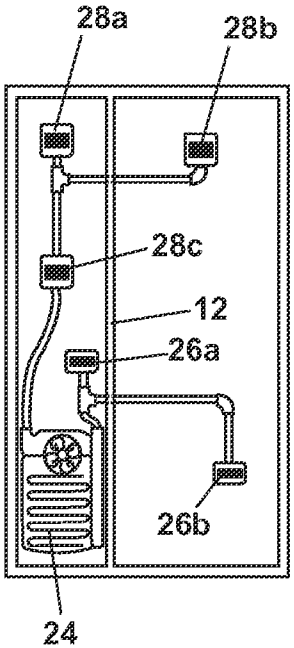
FIG. 10*c* is a schematic view of a configuration of a refrigerator according to an embodiment of the present invention
Figure 10B:
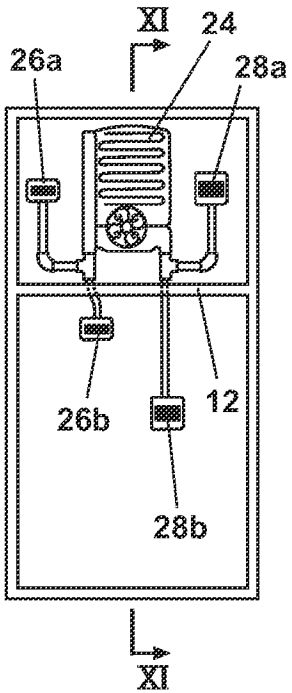
FIG. 10*b* is a schematic view of a configuration of a refrigerator according to an embodiment of the present invention
Figure 10A:
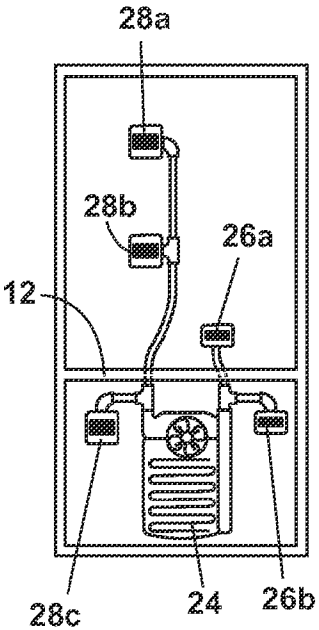
FIG. 10*a* is a schematic view of a configuration of a refrigerator according to an embodiment of the present invention

The refrigeration system may be of the "no-frost" type, i.e. with forced air circulation. As shown in FIG. 11, the compressor, condenser, and fan are preferably positioned in the refrigerator base 30, while the evaporator 24 is preferably placed inside the freezer compartment. The evaporator 24 may operate in a vertical configuration, as shown in FIGS. 10*a*, 10*b*, and 10*c* or in a horizontal configuration, as shown in FIG. 10*d*. The evaporator 24 can be rotated approximately 180 degrees to provide an improved connection between the supply and return cold air conduits. The divider panel 12 is provided with holes for the passage of the conduits, which may be thermally insulated. The heat exchanger of the evaporator 24 may have fins which allows for water drainage during the de-frosting phase.

Several configurations for the evaporator 24, return air conduits 26, and supply air conduits 28 are shown in FIGS. 10*a*, 10*b*, 10*c*, and 10*d*. In the configuration shown in FIG. 10*a* the freezer compartment is provided in the lower portion of the cabinet 10, while in FIG. 10*b* the freezer compartment is provided in the upper portion of the cabinet 10. Thus, FIG. 10*a* shows an embodiment of a bottom mount refrigerator and FIG. 10*b* shows an embodiment of a top mount refrigerator. FIG. 10*c* shows an embodiment of a side by side configuration, with the freezer compartment provided in the left portion of the cabinet 10. FIG. 10*d* shows an embodiment of a refrigerator having a freezer compartment provided in the upper portion of the cabinet 10, and a storage compartment provided in the lower portion of the cabinet 10. The storage compartment may be a freezer compartment, fresh food compartment, or an independent compartment that is not temperature controlled. As one of skill in the art is aware, there are many potential configurations for the evaporator, supply and return air conduits, and divider panels. Thus, the configuration could be changed without altering the function of the invention.

The solution according to the invention provides a complete freedom in positioning the panels 12 in order to produce refrigerators with two or more cavities that have excellent characteristics and performances characteristics.

An advantage of the present invention is that new models of refrigerators can easily be produced to have compartments with varying configurations. Currently, the most common configurations provide two compartments for side by side, top mount and bottom mount refrigerators. The refrigerator according to the present invention allows for the manufacturing of the traditional configuration as well as multiple new configurations having two or more compartments. The compartments can be opened with doors or with drawers or with any combination thereof. Similarly, the number of compartments and method of opening the compartments may be customized to a user's preference, thus providing flexibility in adapting to market trends. Conceptually, the cabinet, the panels and the elongated support device can be considered modules in which different combinations in the final manufacturing assembly can create known and new configurations with a single initial investment.

Additionally, the present invention provides the freedom to design compartments with varying ranges of temperatures for improved food preservation and easier access of groups of food.

Another object of the present invention is the ability to create many space management variations inside an empty cabinet without changing the footprint and the overall dimensions of the refrigerator. This is accomplished by using various insulated panels inside the cabinet that are held in place by an elongated support device. The panels may be mounted horizontally or vertically within the cabinet. This new configuration will provide the same performance and appearance of traditional refrigerators.

While the present invention has been described with reference to the above described embodiments, those of skill in the art will recognize that changes may be made thereto without departing from the scope of the invention as set forth in the appended claims.

The invention claimed is:

1. A refrigerator comprising a cabinet having a cabinet wall, a partition wall to separate the cabinet into two subcompartments and an elongated support device having a C-shaped cross section mounted to the cabinet wall and into which the partition wall is inserted wherein the cross section of the support device presents a central substantially flat portion and two hollow end portions each end portion having a continuous outer peripheral surface formed completely around a hollow center and wherein the central portion presents at least one hollow portion having a continuous outer peripheral surface formed completely around a hollow center to form a seal between the support device and the partition wall.

2. The refrigerator of claim 1, wherein the elongated support device comprises extruded polymeric material.

3. The refrigerator of claim 1, wherein the elongated support device is U-shaped to match the cross section of the cabinet.

4. The refrigerator of claim 1, wherein the end portions present at least one protrusion to form a seal between the support device and the partition wall.

5. The refrigerator of claim 1, wherein the elongated support device is mounted to the cabinet wall using rivets inserted through holes in said cabinet wall.

6. A reconfigurable refrigerator comprising:

a cabinet;

an insulated partition wall; and an elongated support device having a cross section that presents a central substantially flat portion and two hollow end portions each end portion having a continuous outer peripheral surface formed completely around a hollow center, wherein the partition wall is inserted into the elongated support device to provide a customized number of compartments within the cabinet and wherein the central portion presents at least one hollow portion having a continuous outer peripheral surface formed completely around a hollow center to form a seal between the support device and the partition wall.

7. The refrigerator of claim 6, wherein the insulated partition wall is horizontally mounted within the cabinet.

8. The refrigerator of claim 6, wherein the insulated partition wall is vertically mounted within the cabinet.

9. The refrigerator of claim 6, wherein the elongated support device has a C-shaped cross section to mount within the cabinet.

10. The refrigerator of claim 6, wherein the end portions present at least one protrusion to form a seal between the support device and the partition wall.

11. The refrigerator of claim 6, wherein the compartments have an access opening terminated by at least one of the following: a door and drawer.

* * * * *